US005685623A

United States Patent [19]

Katz et al.

[11] Patent Number: 5,685,623

[45] Date of Patent: Nov. 11, 1997

[54] APPLIANCE TOP ASSEMBLY

[75] Inventors: Jonathan Marc Katz; Scott Alan Calvert, both of Louisville, Ky.

[73] Assignee: General Electric Company, Louisville, Ky.

[21] Appl. No.: 416,057

[22] Filed: Apr. 4, 1995

[51] Int. Cl.[6] ..... A47B 47/00

[52] U.S. Cl. ..... 312/263; 312/265.5; 312/293.2

[58] Field of Search ..... 312/293.3, 293.2, 312/293.1, 140.4, 279, 248, 263, 265.5, 265.6, 257.1, 223.1, 228; 220/4.02

[56] References Cited

U.S. PATENT DOCUMENTS

| | | | |
|---|---|---|---|
| 3,253,874 | 5/1966 | Czech | 312/257 |
| 3,338,232 | 8/1967 | Heldenbrand | 312/279 X |
| 3,347,609 | 10/1967 | Mann | 312/263 |
| 4,003,613 | 1/1977 | Oakley | 312/293 |
| 4,288,133 | 9/1981 | Deatherage | 312/279 |
| 4,507,942 | 4/1985 | Hirose | 312/223.1 X |
| 4,765,698 | 8/1988 | Dooley | 312/248 |
| 4,798,424 | 1/1989 | Coates et al. | 312/257 R |
| 4,840,285 | 6/1989 | Carr | 220/4.02 |
| 5,350,140 | 9/1994 | Ripley et al. | 312/257.1 X |
| 5,358,323 | 10/1994 | Ripley | 312/263 X |
| 5,375,921 | 12/1994 | Tupa et al. | 312/279 X |

FOREIGN PATENT DOCUMENTS

| | | | |
|---|---|---|---|
| 22948 | 3/1978 | Japan | 312/265.6 |

*Primary Examiner*—Peter M. Cuomo
*Assistant Examiner*—Janet M. Wilkens
*Attorney, Agent, or Firm*—H. Neil Houser

[57] ABSTRACT

A top assembly for an appliance, such as a top loading clothes washer, includes a top support member. A top panel is attached to and positioned over the support member. The top panel terminates forward of the rear of the support member and includes a rear portion extending side to side of the support member. A control housing includes an assembly of a rear wall and end caps. The end caps are mounted on the support member and extend rearward of the rear portion of the top panel and the rear wall extends across the rear of the support member. The control housing also includes a control panel assembly mounted on the rear portion of the top panel and attached to the rear wall and end cap assembly.

20 Claims, 2 Drawing Sheets

APPLIANCE TOP ASSEMBLY

BACKGROUND OF THE INVENTION

The present invention relates to appliances and, more particularly, to top loading clothes washing machines. In such machines a top panel or cover provides access to the basket for loading and unloading items to be washed and a housing is provided at the rear of the cover to contain various user actuated controls for the machine.

It is an object of this invention to provide an improved top assembly for such machines.

It is a further object of this invention to provide such an improved assembly including a top support member.

It is a still further object of this invention to provide such an improved assembly in which the top panel and control housing are mounted on a top support member.

SUMMARY OF THE INVENTION

In accordance with one embodiment of the invention an appliance top assembly includes a top support member. A plurality of housing panels are attached to said support member and depend therefrom to define lateral walls of the appliance. A top panel is attached to and positioned over the support member. The top panel terminates forward of the rear of the support member and includes a rear portion extending side to side of the support member. A control housing includes an assembly of an elongated rear wall with lateral ends joined to a pair of spaced apart end caps. The end caps are mounted on the support member and extend rearward of the rear portion of the top panel and the control housing rear wall extends across the rear of the support member. The control housing also includes a control panel assembly mounted on the rear portion of the top panel and attached to the control housing rear wall and end cap assembly.

DETAILED DESCRIPTION OF PREFERRED EMBODIMENT

Figure 1:
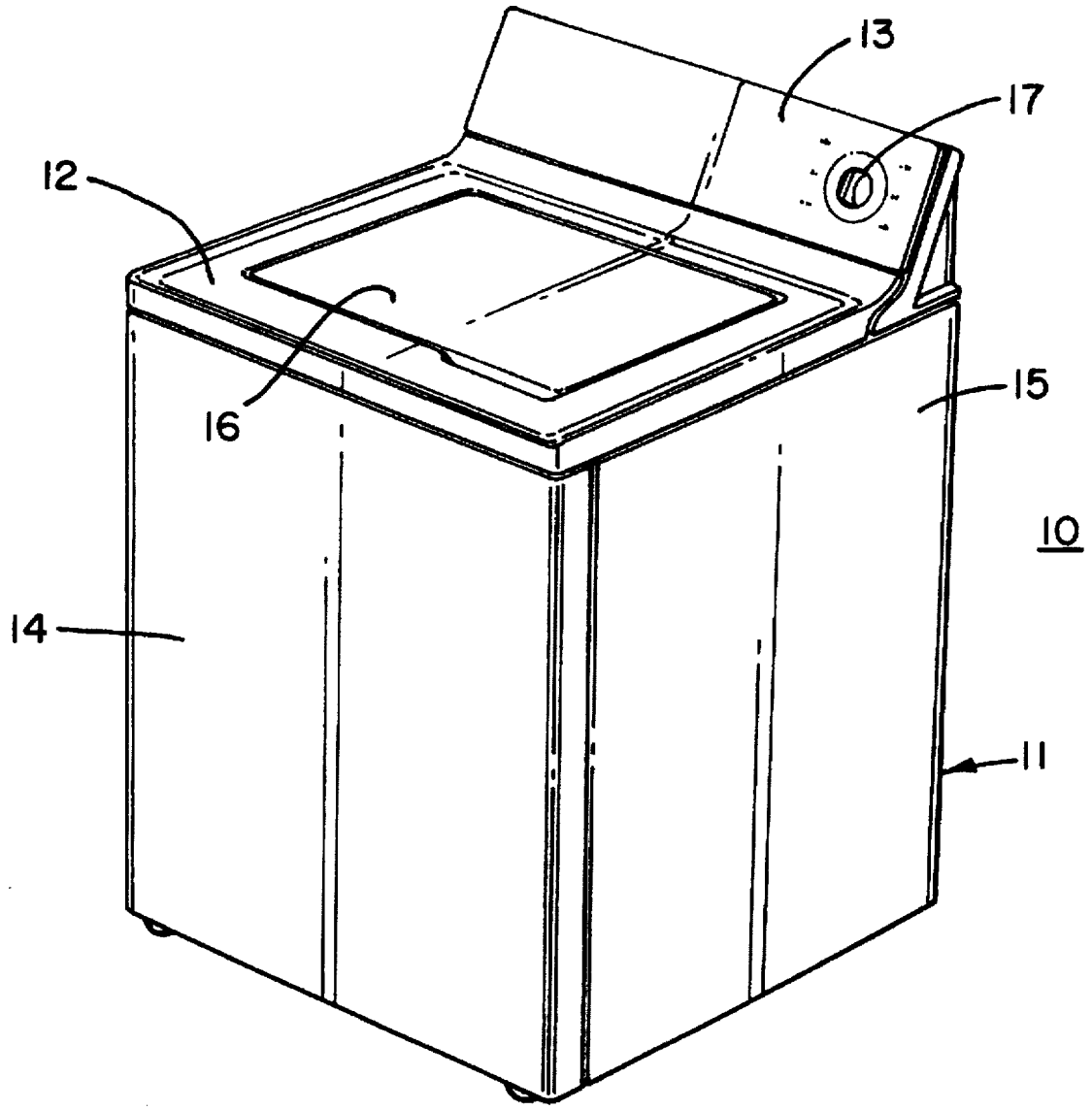
FIG. 1 is a front perspective view of an automatic clothes washing machine incorporating one embodiment of the present invention.

Referring to FIG. 1, there is illustrated a clothes washing machine 10 including a cabinet 11, cover or top panel 12 and control housing 13. The cabinet includes four housing panels, including front panel 14 and side panel 15; as well as a rear panel and an opposite side panel, not shown. The cover 12 includes a lid 16 that provides access to the interior of the machine for inserting and removing items that are washed. Control housing 13 encloses various user operated controls, such as timer 17, for regulating operation of the machine. It will be understood that numerous other controls, such as speed selectors, load size input switches, and water temperature selectors are included in housing 13 of different machines, depending upon the features of that particular machine. As such controls do not form part of the present invention, they have been omitted for the sake of simplicity.

Figure 2:
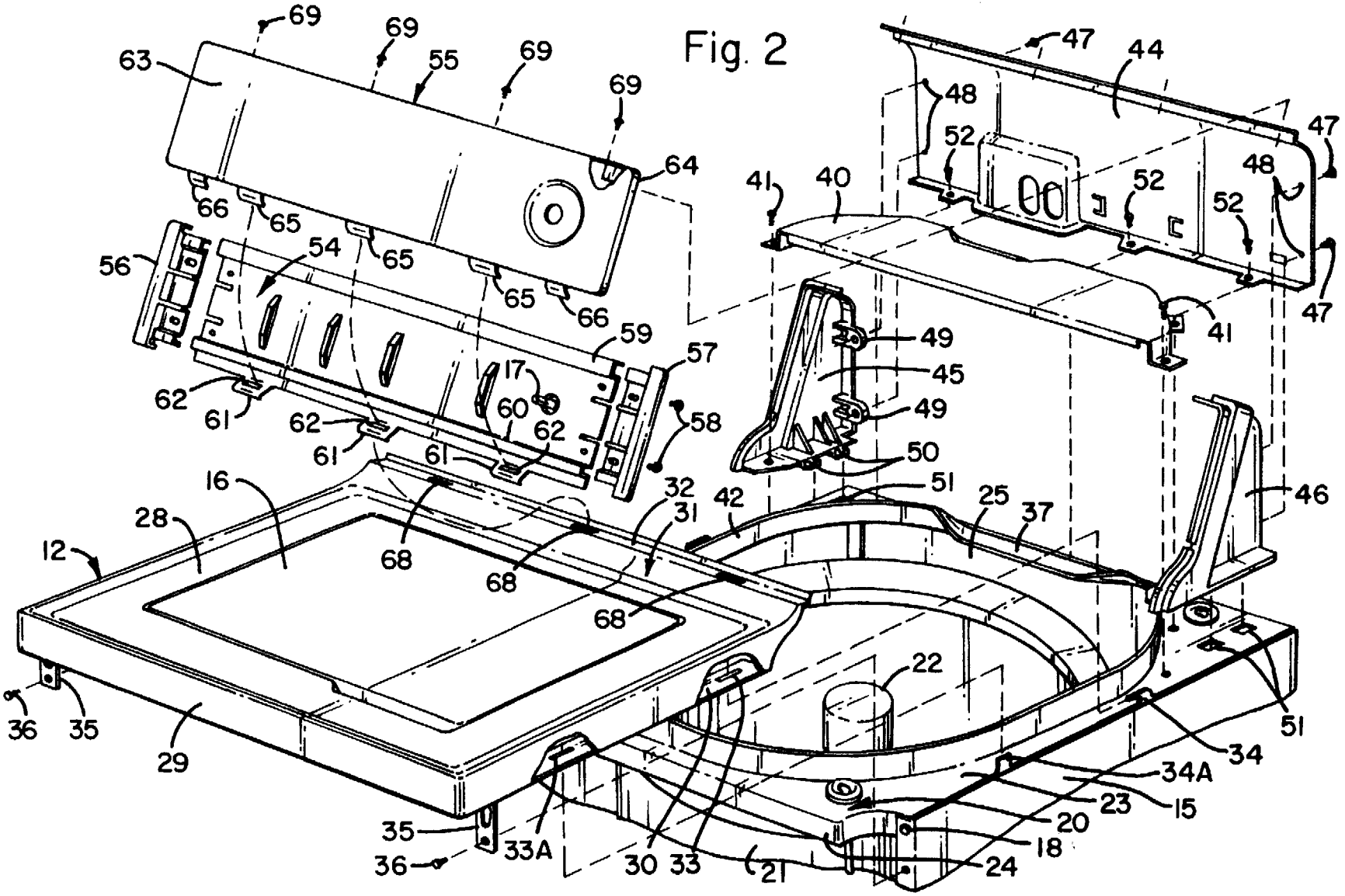
FIG. 2 is an exploded perspective view of the top assembly of the washing machine of FIG. 1.

Referring now more particularly to FIG. 2, it will be seen that the machine 10 includes a top support member 20 which serves as the base on which various other members and assemblies of the machine are mounted. For example the various housing panels, such as side panel 15 for example, are attached to support member 20 by screws 18 and depend therefrom to form the cabinet 11. In addition the support member 20 supports various operating components of the machine, such as the tub 21 and agitator 22 for example. The support member is generally in the form of a horizontal rectangular sheet 23 having the cross section size and shape of the machine. The sheet includes a down turned edge or rim 24 which adds structural strength and rigidity. The central portion of the member 20 is formed with an opening 25 to provide access to the interior of the machine.

The cover or top panel 12 is in the general form of a horizontal rectangular sheet 28 with a depending edge or rim 29 and a lower, horizontal flange 30. The rear portion 31 of the panel 12 is upswept and includes a horizontal flange 32. The central portion of the panel is formed with an opening that is selectively closed by lid 16.

The top panel 12 is mounted on the support member 20 by a slot and hook and tab arrangement. More particularly, in the illustrative embodiment the lower flange 30 is provided with slots 33 and 33A. The support member 20 includes corresponding upwardly projecting hooks 34 and generally rectangular tabs 34A. The top panel is placed on the support member with the hooks 34 extending through the slots 33 and with the tabs 34A extending through the slots 33A. The top panel 12 is then slid to the rear so that the hooks 34 overlap the material of the flange 30 and the tabs 34A are juxtaposed to, and preferably abut, the front edges of the slots 33A. The hooks 34 secure the rear of the panel 12 against vertical movement. The tabs 34A limit rearward movement of the top panel 12 and assure that it is positioned juxtaposed to the end caps 45,46. In addition, they aid in maintaining the lateral fit of the top panel 12 and support member 20. Mounting brackets 35 attached to front corners of top panel 12 then are attached to the support member rim 24, or to the adjacent housing panels by threaded fasteners, such as screws 36. These brackets secure the front of the top panel 12 against vertical movement.

The panel 12 is more narrow front to rear than the support member 20 and the panel rear portion 31 is positioned forward of the rear edge 37 of the support member, when the panel is fully mounted on the support member. The support member opening 25 extends further to the rear than the top panel 12 and a cover 40 is mounted on the rear portion of the support member by threaded fasteners like screws 41 and closes the portion of opening 25 not under the top panel 12. A gasket 42 is attached to the support member 20 around the opening 25 and engages both the top panel 12 and the cover 40 to substantially prevent moisture from escaping upwardly into control housing 13.

The control housing 13 includes two assemblies. The first assembly includes the elongated control housing rear wall 44 and spaced apart end caps 45,46. The opposite lateral ends of the wall 44 are connected to the end caps by threaded fasteners such as screws 47 which pass through openings 48 in the rear wall 44 and are received in tabs 49 in the end caps. The rear wall and end cap assembly is mounted on the support member 20 by a hook and slot arrangement. In the exemplification embodiment the end caps include hooks 50 which are received in slots 51 in support member 20. Once the hooks and slots are engaged, the rear wall and end cap assembly is moved rearward so the hooks overlap the adjacent portions of the support member 20. Then the lower edge of the rear wall 44 is attached to the support member 20 by suitable fasteners, such as screws 52. If desired some of the screws 52 also pass through the cover 40 to help attach the cover to the support member.

The second control housing assembly includes switch mounting plate 54 and cover sheet 55. The elongated mounting plate 54 is formed of relatively heavy metal, such as sheet steel, and serves as a mounting for various controls, such as timer 17. If desired plastic caps 56,57 are mounted to the ends of plate 54 by suitably means like screws 58. The mounting plate includes upper and lower ribs 59,60 which, together with the caps 56,57 form a rim around the periphery of the plate. A plurality of tabs 61 project downwardly of the lower rib 60 and each tab includes a slot 62.

The cover sheet 55 conveniently may be formed of a thin sheet of decorative metal and conveniently includes graphic elements. The sheet 55 includes a generally planar front 63 surrounded by a rearwardly projecting rim or flange 64. A plurality of tabs 65 project downwardly of the lower edge of rim 64 and correspond to the slots 62 in the mounting plate tabs 61. If desired, additional tabs 66 also project downwardly of the rim 64. The plate 54 and sheet 55 are assembled by inserting tabs 65 through slots 62 and rotating the members 54,55 together so that the rim around plate 54 fits within the rim or flange 64 of cover 55. The tabs 65 are then bent over to secure the members together. Also, if desired the additional tabs 66 are bent over to provide additional strength and rigidity.

The assembly of plate 54 and sheet 55 is mounted on the machine 10 by inserting the tabs 61 into corresponding slots 68 formed in the flange 32 along the rear portion 31 of top panel 12. The plate and cover sheet assembly then is rotated rearward to engage the rear wall 44 and end caps 45,46 and the two control housing assemblies are joined or attached by suitable fasteners, such as screws 69 that pass through the plate 54, cover sheet 55 and are received in the rear wall 44 and end caps 45,46.

Assembly of the exemplification top assembly conveniently is as follows: first the assembly of the control housing rear wall 44 and end caps 45,46 is mounted on the support member 20, then the cover 40 is mounted on the support member 20, then the top panel 12 is mounted on the support member with its rear portion 31 juxtaposed to the end caps 45,46, and finally the assembly of the mounting plate 54 and cover sheet 55 is mounted on the rear portion of top panel 12 and attached to the rear wall 44 and end caps 45,46.

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. An appliance top assembly comprising:

a top support member comprising a top opening for enabling access to an inside portion of an appliance;

a plurality of housing panels attached to said support member and depending therefrom to define lateral walls of said appliance;

a top panel attached to and positioned over said support member, said top panel terminating forward of a rear of said support member, said top panel comprising a rear portion extending side to side of said support member;

a control housing comprising an assembly of an elongated rear wall with lateral ends joined to a pair of spaced apart end caps, said end caps mounted on said support member and extending rearward from said rear portion of said top panel with said rear wall extending across said rear of said support member; and said control housing further comprising a control panel assembly mounted on said rear portion of said top panel and attached to said rear wall and end cap assembly.

2. An assembly as set forth in claim 1, wherein: a portion of said top opening extends rearward of said rear portion of said top panel.

3. An assembly as set forth in claim 2, further including:

a cover mounted on said support member between said control housing end caps and covering said portion of said top opening extending rearward of said rear portion of said top panel; and a plurality a fasteners mounting said cover to said support member and at least some of said fasteners also mounting said control housing rear wall to said support member.

4. An assembly as set forth in claim 1, wherein:

said rear portion of said top panel is upturned and includes a series of spaced apart slots; and said control panel assembly includes a plurality of spaced apart depending tabs with said tabs being received in corresponding one of said slots to mount said control panel assembly on said top panel.

5. An assembly as set forth in claim 4, further including: fasteners releasably attaching said control panel assembly to said rear wall and end cap assembly, whereby said control panel assembly is selectively rotatable about the connection of its tabs in the corresponding slots in said rear portion of said top panel.

6. An assembly as set forth in claim 1, wherein:

said end caps and support member include cooperating slots and hooks for mounting said end caps on said support member and said support member and top panel include cooperating slots and hooks for mounting said top panel on said support member with said rear portion of said top panel engaging said end caps.

7. An assembly as set forth in claim 6, wherein: said support member and said top panel include cooperating slots and tabs positioning said top panel juxtaposed to said end caps.

8. An assembly as set forth in claim 6, further including: fasteners attaching said control housing rear wall to said support member.

9. An assembly as set forth in claim 6, further including: fasteners attaching the front of said top panel to corresponding housing panels.

10. An appliance top assembly comprising:

a top support member comprising a top opening for enabling access to an inside portion of an appliance;

a plurality of housing panels attached to said support member and depending therefrom to define lateral walls of said appliance;

a top panel attached to and positioned over said support member, said top panel terminating forward of a rear of said support member, said top panel comprising a rear portion extending side to side of said support member, a portion of said top opening extending rearward of said rear portion of said top panel;

a control housing comprising an assembly of an elongated rear wall with lateral ends joined to a pair of spaced apart end caps, said end caps mounted on said support member and extending rearward from said rear portion of said top panel with said rear wall extending across said rear of said support member;

said control housing further comprising a control panel assembly mounted on said rear portion of said top panel and attached to said rear wall and end cap assembly; and a cover mounted on said support member between said control housing end caps and covering said portion of said top opening extending rearward of said rear portion of said top panel.

11. An assembly as set forth in claim 10, further comprising:

a plurality a fasteners mounting said cover to said support member and at least some of said fasteners also mounting said control housing rear wall to said support member.

12. An assembly as set forth in claim 10, wherein:

said rear portion of said top panel is upturned and includes a series of spaced apart slots; and said control panel assembly comprises a plurality of spaced apart depending tabs with said tabs being received in corresponding one of said slots to mount said control panel assembly on said top panel.

13. An assembly as set forth in claim 12, further comprising: fasteners releasably attaching said control panel assembly to said rear wall and end cap assembly, whereby said control panel assembly is selectively rotatable about the connection of its tabs in the corresponding slots in said rear portion of said top panel.

14. An assembly as set forth in claim 10, wherein:

said end caps and support member include cooperating slots and hooks for mounting said end caps on said support member and said support member and top panel include cooperating slots and hooks for mounting said top panel on said support member with said rear portion of said top panel engaging said end caps.

15. An assembly as set forth in claim 14, wherein: said support member and said top panel include cooperating slots and tabs positioning said top panel juxtaposed to said end caps, and said assembly further comprises fasteners attaching said control housing rear wall to said support member, and fasteners attaching the front of said top panel to corresponding housing panels.

16. An appliance top assembly comprising:

a top support member;

a plurality of housing panels attached to said support member and depending therefrom to define lateral walls of an appliance;

a top panel attached to and positioned over said support member, said top panel terminating forward of a rear of said support member, said top panel comprising a rear portion extending side to side of said support member;

a control housing comprising an assembly of an elongated rear wall with lateral ends joined to a pair of spaced apart end caps, said end caps mounted on said support member and extending rearward from said rear portion of said top panel with said rear wall extending across said rear of said support member, said end caps and support member comprising cooperating slots and hooks for mounting said end caps on said support member, and said support member and top panel comprising cooperating slots and hooks for mounting said top panel on said support member with said rear portion of said top panel engaging said end caps; and said control housing further comprising a control panel assembly mounted on said rear portion of said top panel and attached to said rear wall and end cap assembly.

17. An assembly as set forth in claim 16, wherein: said support member defines a top opening for access to the inside of said appliance with a portion of said opening extending rearward of said rear portion of said top panel; and a cover mounted on said support member between said control housing end caps and covering said portion of said top opening extending rearward of said rear portion of said top panel.

18. An assembly as set forth in claim 17, further including:

a plurality a fasteners mounting said cover to said support member and at least some of said fasteners also mounting said control housing rear wall to said support member.

19. An assembly as set forth in claim 16, wherein:

said rear portion of said top panel is upturned and includes a series of spaced apart slots; and said control panel assembly includes a plurality of spaced apart depending tabs with said tabs being received in corresponding one of said slots to mount said control panel assembly on said top panel.

20. An assembly as set forth in claim 19, further including: fasteners releasably attaching said control panel assembly to said rear wall and end cap assembly, whereby said control panel assembly is selectively rotatable about the connection of its tabs in the corresponding slots in said rear portion of said top panel.

* * * * *